US009229386B2

(12) United States Patent
Yokomizo

(10) Patent No.: US 9,229,386 B2
(45) Date of Patent: Jan. 5, 2016

(54) IMAGE FORMING APPARATUS, CONTROL METHOD FOR IMAGE FORMING APPARATUS, AND PROGRAM

(71) Applicant: CANON KABUSHIKI KAISHA, Tokyo (JP)

(72) Inventor: Tsuyoshi Yokomizo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/473,722

(22) Filed: Aug. 29, 2014

(65) Prior Publication Data

US 2015/0063847 A1 Mar. 5, 2015

(30) Foreign Application Priority Data

Sep. 2, 2013 (JP) ..... 2013-181329

(51) Int. Cl.
*G03G 15/00* (2006.01)
*G03G 15/20* (2006.01)

(52) U.S. Cl.
CPC ..... *G03G 15/205* (2013.01); *G03G 15/2046* (2013.01); *G03G 15/80* (2013.01)

(58) Field of Classification Search
USPC ..... 399/38, 45, 67–70, 107, 110, 122, 320, 399/328, 389
See application file for complete search history.

(56) References Cited

U.S. PATENT DOCUMENTS 7,327,964 B2 * 2/2008 Funabiki et al. ..... 399/45
7,382,992 B2 * 6/2008 Takeda ..... G03G 15/6591 399/389
7,945,181 B2 * 5/2011 Okada ..... 399/69
8,731,423 B2 * 5/2014 Arakawa ..... G03G 15/205 399/45

FOREIGN PATENT DOCUMENTS

JP 06-348159 A 12/1994
JP 07-271226 A 10/1995
JP 2007-199597 A 8/2007

* cited by examiner

*Primary Examiner* — Hoan Tran
(74) *Attorney, Agent, or Firm* — Canon U.S.A., Inc. IP Division

(57) ABSTRACT

In an image forming apparatus including an image forming unit configured to transfer a developing agent to a sheet for image forming and a plurality of fixing units each configured to perform a heat-fixing process on the developing agent transferred to the sheet by the image forming unit, whether the sheet is of a type for which a plurality of fixing units are to be used for performing a heat-fixing process is determined. It is controlled so as to electrify one fixing unit of the fixing units and not to electrify the other fixing units not to be used until the number of sheets having undergone the heat-fixing process by using the one fixing unit is equal to a predetermined number if the determining determines that the sheet is of a type for which a plurality of fixing units are to be used for performing a heat-fixing process.

8 Claims, 12 Drawing Sheets

FIG. 10

| 1201 ( TYPES OF MATERIAL | 1202 ( USE OF SECOND FIXER |
|---|---|
| THIN PAPER | NO |
| NORMAL PAPER | NO |
| THICK PAPER 1 | NO |
| THICK PAPER 2 | NO |
| THICK PAPER 3 | YES |
| THICK PAPER 4 | YES |
| GLOSSY PAPER | YES |
| ONE-SIDED COATED PAPER 1 | YES |
| ONE-SIDED COATED PAPER 2 | YES |
| DOUBLE-SIDED COATED PAPER 1 | YES |
| DOUBLE-SIDED COATED PAPER 2 | YES |
| OHP FILM | YES |
| ⋮ | ⋮ |

IMAGE FORMING APPARATUS, CONTROL METHOD FOR IMAGE FORMING APPARATUS, AND PROGRAM

BACKGROUND OF THE INVENTION

1. Field of the Invention

The present invention relates to an image forming apparatus including a plurality of fixing units, a control method for an image forming apparatus, and a program.

2. Description of the Related Art

In an image forming apparatus, an unfixed image drawn normally with toner on a material is fixed to a surface of the material by heating it under pressure in a fixer. Such a fixer is heated by an internal heater, and it is controlled such that the amount of heat taken away by a material passing therethrough could be compensated to keep the temperature necessary for fixing.

An increased number of types of material to be conveyed through an image forming apparatus are available yearly. However, it may be difficult for an image forming apparatus configured to perform image fixing with one fixer to provide all of stable fixability, image quality of fixed images and productivity on all types of material. In order to address this and in order to avoid problems such as shortage of a heat amount due to such a configuration with one fixer, a plurality of fixers may be serially connected in a conveying path (as disclosed in Japanese Patent Laid-Open Nos. 06-348159 and 07-271226).

A method has also been disclosed (in Japanese Patent Laid-Open No. 2007-199597) in which when a predetermined fixer is not available, the processing speed for fixing may be reduced so that the fixing process may be performed by the other fixers only.

In an image forming apparatus having a plurality of fixers, keeping the temperatures of the plurality of fixers may consume a large amount of power. Normally, one fixer may be used for the most frequently used normal sheet, for example. Keeping the temperatures of a plurality of fixers is necessary for less frequently used materials, which unnecessarily consume power.

Even temperatures of a plurality of fixers that are kept as described above must be further increased to a temperature required for performing a fixing process, which further consumes power. Use of a plurality of fixers for printing a few sheets may consume more power than printing them with one fixer, which is also disadvantageous in terms of the printing performance.

SUMMARY OF THE INVENTION

An aspect of the present invention provides an image forming apparatus including an image forming unit configured to transfer a developing agent to a sheet for image forming, a plurality of fixing units each configured to perform a heat-fixing process on the developing agent transferred to the sheet by the image forming unit, a determination unit configured to determine whether the sheet is of a type for which a plurality of fixing units are to be used for performing a heat-fixing process, and a controller configured to control so as to electrify one fixing unit of the fixing units and not to electrify the other fixing units not to be used until the number of sheets having undergone the heat-fixing process by using the one fixing unit is equal to a predetermined number if the determination unit determines that the sheet is of a type for which a plurality of fixing units are to be used for performing a heat-fixing process.

Further features of the present invention will become apparent from the following description of exemplary embodiments with reference to the attached drawings.

BRIEF DESCRIPTION OF THE DRAWINGS

FIG. 10 illustrates an exemplary fixing control table.

DESCRIPTION OF THE EMBODIMENTS

Embodiments of the present invention will be described with reference to drawings.

System Configuration

First Embodiment

Figure 1:
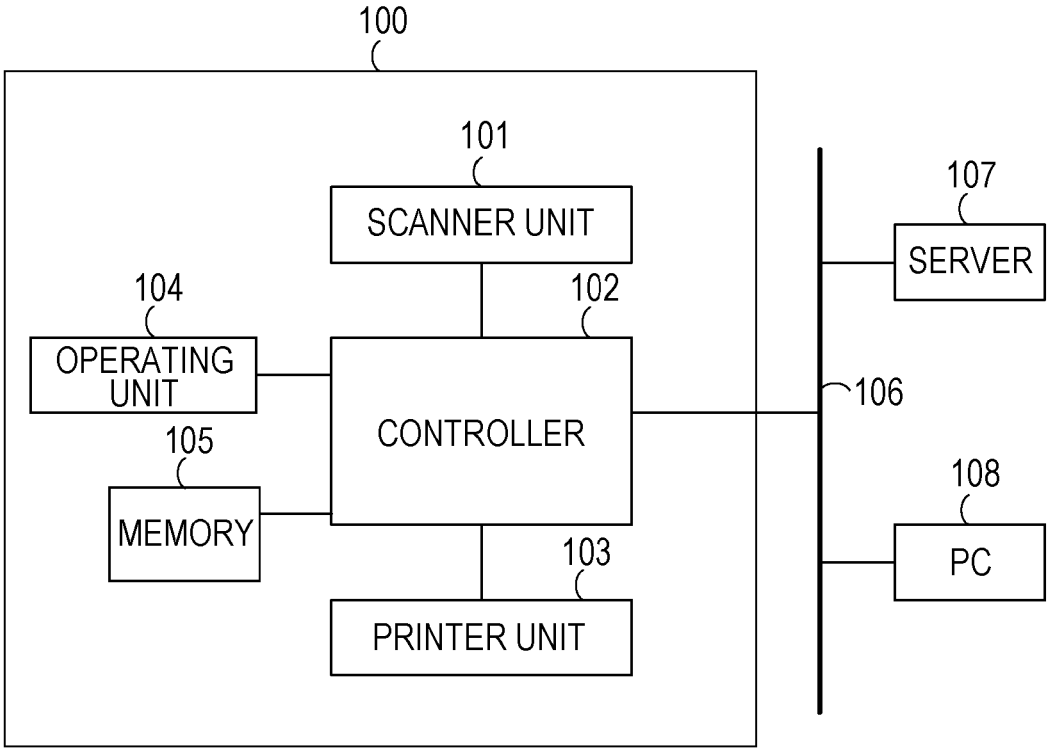
FIG. 1 illustrates an exemplary image processing system including an image forming apparatus.

FIG. 1 illustrates an exemplary image processing system including an image forming apparatus according to a first embodiment. According to this embodiment, a digital multifunction peripheral having typical COPY/PRINT/FAX functions will be described as an example of the image forming apparatus. However, the present invention is applicable to an apparatus configured to perform heat-fixing, such as a printing apparatus and a facsimile machine.

As illustrated in FIG. 1, an image forming apparatus 100 includes a scanner unit 101 configured to perform document reading processing, and a controller 102 configured to perform image processing on an image read by the scanner unit 101 and store it to a memory 105.

The image forming apparatus 100 further includes an operating unit 104 usable for setting printing conditions for an image read by the scanner unit 101 and a printer unit 103 configured to perform image forming on a recording sheet for visualizing image data read from the memory 105 based on the print setting conditions defined through the operating unit 104. A server 107 and a personal computer (PC) 108 are connected to the image forming apparatus 100 that is a multifunction peripheral through a network 106. The server 107 is configured to manage image data, and the PC 108 is configured to cause the image forming apparatus 100 to execute printing.

Figure 2:
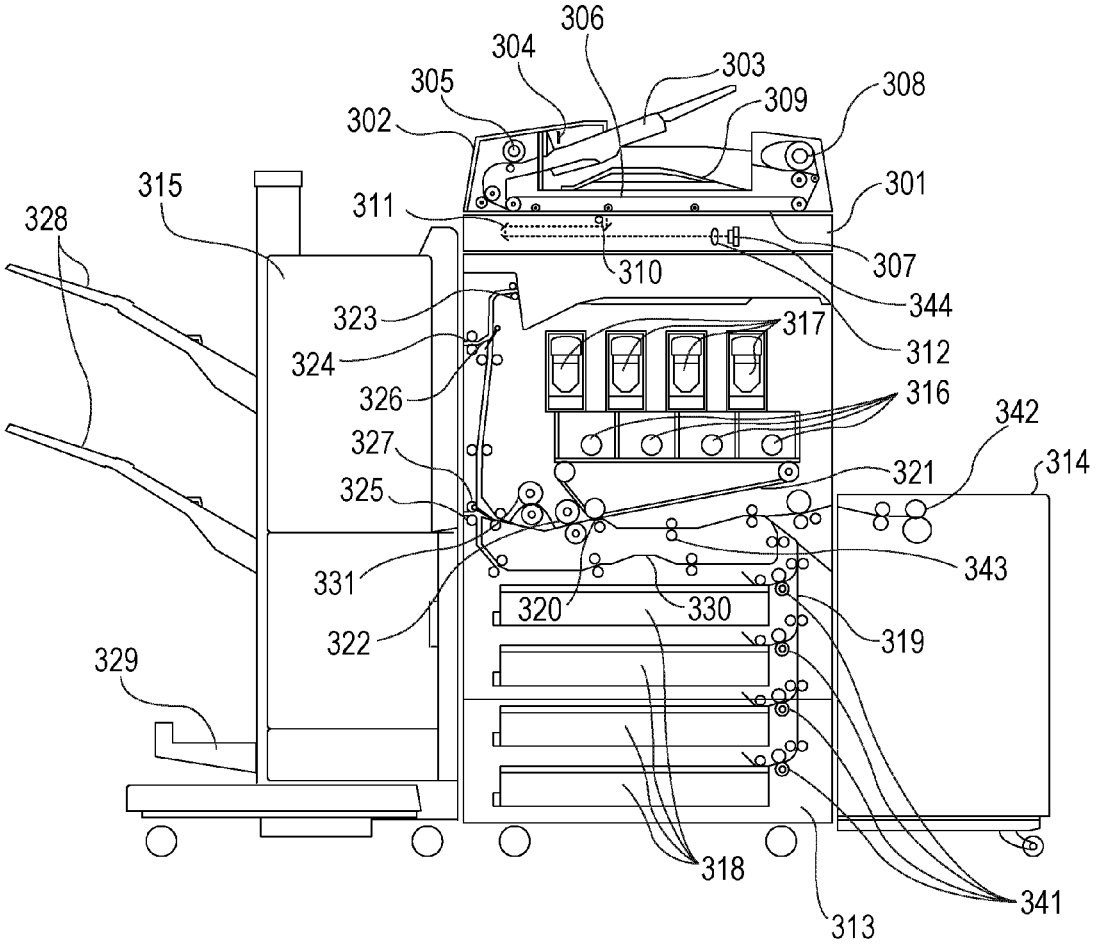
FIG. 2 is a section view for explaining a configuration of an image forming apparatus.

FIG. 2 is a section view for explaining a configuration of the image forming apparatus 100 illustrated in FIG. 1. It should be noted that the image forming apparatus 100 is a multifunction peripheral as illustrated in FIG. 1 having copy, printing and facsimile functions.

Referring to FIG. 2, the image forming apparatus 100 includes a scanner unit 301, a document feeder (DF) 302, a printer 313 for printing including a 4-color drum, a sheet feed deck 314, and a finisher 315.

For reading a document, the document may be mounted face-up on a document set tray 303 of the DF 302. Then, a document presence/absence sensor 304 may detect that a document has been set. In response to it, a feeding roller 305 and a carrying belt 306 rotate to convey the document. Thus, the document is set at a predetermined position on a platen glass 307. After this, an image is read in the same manner as that on the platen glass, and the resulting data is stored in memory within the controller 102.

After the scanner unit 301 completes the image reading from the document, the carrying belt 306 rotates again and feeds the document to the right-hand side of FIG. 2. The fed document passes through a discharging conveying roller 308 and is discharged to a document discharge tray 309.

It should be noted that in a case where a plurality of documents are present, a document is discharged and conveyed from the platen glass to the right-hand side of FIG. 2 and at the same time the next document is conveyed from the left-hand side through the feeding roller 305 so that the next document may be read continuously. These steps are operations to be performed by the scanner unit 301.

Next, printing operations to be performed mainly by the printer unit 103 will be described.

A recording medium (or material) such as a sheet is fed from one of cassettes 318 or a sheet feed deck 314 mounted in a lower part of the printer 313. For feeding from one of the cassettes 318, a recording medium is conveyed by a feeding roller pair 341 corresponding to the cassette to a sheet conveying path 319.

For feeding from the sheet feed deck 314, a recording medium is conveyed by a feeding roller pair 342 within the sheet feed deck 314 to the sheet conveying path 319. When the recording medium reaches a regist roller pair 343, it stops once for synchronization with an intermediate transfer belt 321. When some recording medium is waiting for being transferred at the regist roller pair 343, a recording medium on which the next page is to be printed may be fed from the cassette 318 or sheet feed deck 314.

In this case, the fed recording medium may be held in the middle of the sheet conveying path 319 until the recording medium staying at the regist roller pair 343 is conveyed again. Performing sheet feeding in such a manner may reduce the times between transfers of a plurality of recording media and thus may improve productivity. This will be called preceding sheet feeding.

On the other hand, a print signal (print image data) once stored in memory within the controller 102 illustrated in FIG. 1 is transferred to the printer unit 103 and is converted by a laser recording unit to recording laser beams of four colors of Yellow, Magenta, Cyan, and Black. The laser beams are irradiated to photosensitive bodies 316 for corresponding colors so that electrostatic-latent image is formed on the photosensitive bodies. Toner (developing agent) developing is performed thereon with toners supplied from toner cartridges 317. The resulting visualized images are primarily transferred to the intermediate transfer belt 321. After that, the intermediate transfer belt 321 rotates clockwise at a constant speed. When the intermediate transfer belt 321 rotates to a predetermined position, a recording medium at the regist roller pair 343 is started to be conveyed.

The expression "predetermined position" here refers to a position where an end of a recording medium is conveyed to a secondary transfer position 320 when an end of an image transferred onto the intermediate transfer belt 321 reaches the secondary transfer position 320. At the secondary transfer position 320, the image on the intermediate transfer belt 321 is transferred to the recording medium.

The recording sheet to which the image has been transferred is fixed with toner by pressure and heat in a first fixer 322. After the recording sheet is conveyed through a discharge conveying path, it may be discharged to a face-down center tray 323, to a sheet output port 324 to be followed by a finisher by switching back, or to a face-up side tray 325. The side tray 325 is a sheet output port available only when the finisher 315 is not mounted. Flappers 326 and 327 are usable for switching the conveying path in order to switch the sheet output port.

In double-side printing, after a recording sheet passes through the first fixer 322, the flapper 327 switches the conveying path. Then, the sheet is switched back, is fed downward and is conveyed back to the secondary transfer position 320 through a double printing sheet conveying path 330 to undergo double-side printing operations.

Next, operations to be performed in the finisher 315 will be described.

The finisher 315 performs post processing on a printed sheet based on a function designated by a user. More specifically, the finisher 315 may have functions such as stapling setting (one and two position binding modes) and punching (two-hole and three-hole punching), and binding saddle stitch.

The image forming apparatus 100 illustrated in FIG. 2 has two discharge trays 328. A recording sheet having passed through the sheet output port 324 to the finisher 315 is sorted to a discharge tray corresponding to a copy, printing or facsimile function set by a user. Having described that the printer 313 is a 4-color drum printer, it may be a 1-color drum engine or may be a printer engine for monochrome printing. In a case where the printer 313 is utilized as a printer, some drivers may provide settings such as monochrome printing/polychrome printing, sheet size setting, 2UP/4UP printing, N-UP printing, double-side printing, stapling setting, punching, binding saddle stitch, slip paper insertion, front cover insertion, and back cover insertion.

Figure 3:
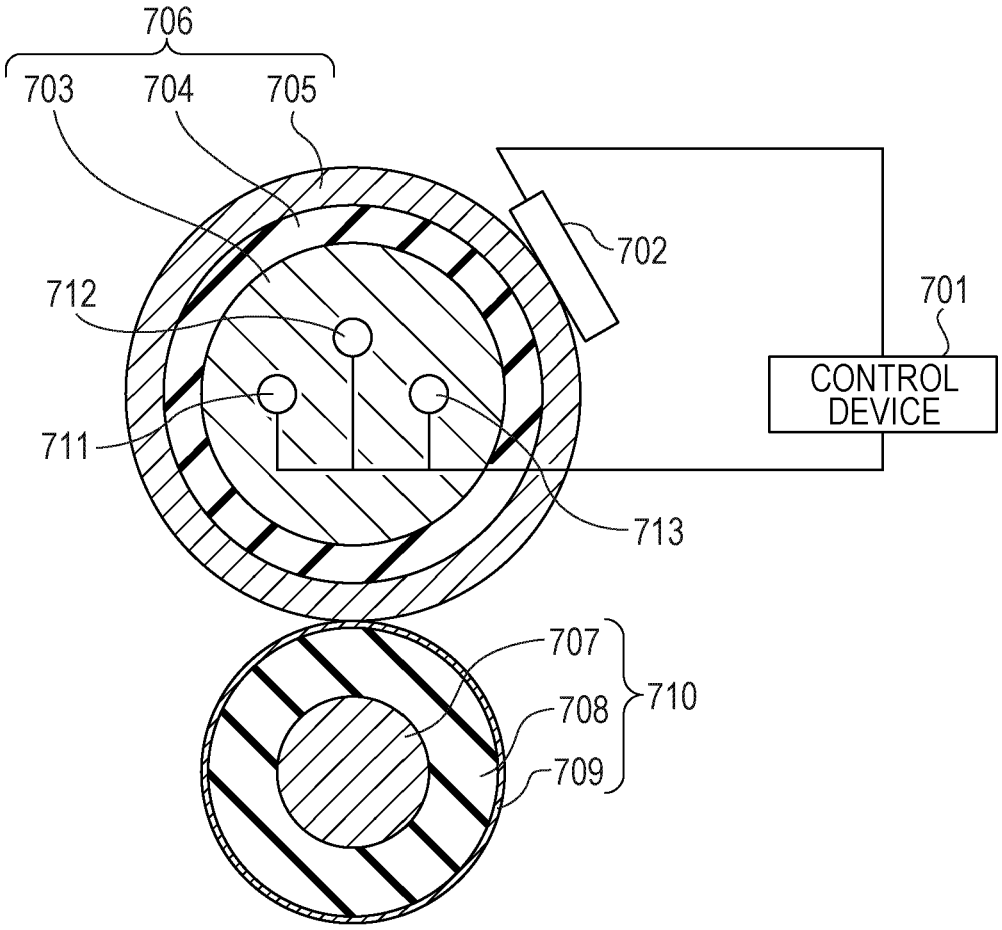
FIG. 3 illustrates a configuration of each fixer illustrated in FIG. 2.

FIG. 3 illustrates a configuration of the first fixer 322 illustrated in FIG. 2.

The first fixer 322 according to this embodiment has a fixing roller 706 to be in contact with a toner image on a front side of a recording medium and a pressing roller 710 to be in contact with the back side, as illustrated in FIG. 3. In the first fixer 322, pressure and heat are applied to a recording medium bearing an unfixed toner image on its front side is being sandwiched and conveyed by a fixing nip between the fixing roller 706 and the pressing roller 710 to fix its toner.

The fixing roller 706 has a silicone rubber layer 704 functioning as an elastic layer on a steel core metal 703 and a PFA coating layer that is a toner release layer 705 on a surface of the silicone rubber layer 704. The toner release layer 705 is produced by applying electrostatic coating with PFA powder into a desirable thickness and then sintering it. On the other hand, the pressing roller 710 has a silicone rubber layer 708 on a steel solid core metal 707 and a PFA tube layer 709 on a surface of the silicone rubber layer 708. The fixing roller 706 and pressing roller 710 are pressurized by a pressure mechanism, not illustrated. In a fixing process, the fixing roller 706 and pressing roller 710 rotate to sandwich and convey a recording medium.

The fixing roller 706 described above has three halogen heaters 711, 712, and 713 as heating units within the hollow steel core metal 703. A thermistor 702 that is an example of a temperature sensor is arranged in contact with the fixing roller 706 to sense a temperature of the fixing roller 706. Based on the sensed temperature, a control device 701 controls switching on/off the halogen heaters 711, 712, and 713 to keep the fixing roller 706 at an even temperature.

Here, the control device 701 is capable of switching between a normal power mode corresponding to a first power state and a power saving mode corresponding to a second power state that is more energy saving than the first power state.

In the normal power mode, the control device 701 switches on all of the three halogen heaters 711, 712, and 713 for temperature control of the fixing roller 706. In the power saving mode, on the other hand, the halogen heater 712 of the three halogen heaters is not switched on and the two halogen heaters 711 and 713 are switched on for temperature control of the fixing roller 706. Thus, in the power saving mode, the first fixer 322 consumes ⅔ of the power consumed in the normal power mode.

In a fixing process, when a recording medium passes through the fixing nip between the fixing roller 706 and the pressing roller 710, the recording medium takes away heat of the fixing roller 706 and pressing roller 710. Accordingly, the control device 701 controls the switching on/off of the halogen heaters 711, 712, and 713 to supply the amount of heat equivalent to the amount of heat taken away by a recording medium to the fixing roller 706 based on the surface temperature of the PFA coating layer 705 sensed by the thermistor 702. However, because the power consumption of the halogen heaters in the power saving mode is ⅔ of the power consumption in the normal power mode, the amount of heat that may be supplied to the fixing roller 706 per unit period of time is approximately ⅔. For that, when an equal number of recording media pass through the first fixer 322 within a unit period of time both in the normal power mode and in the power saving mode, it may be difficult to supply a sufficient amount of heat to the fixing roller 706 in the power saving mode, resulting in a reduced temperature of the fixing roller 706 and possibly causing defective fixing.

In order to avoid this, the controller 102 may increase the passing intervals of recording media more in the power saving mode compared with the normal power mode to reduce the number of passing recording media per unit period of time. The passing intervals of recording media may be adjusted in the power saving mode such that 60-ppm (Paper Per Minute) A4 size cross feed in the normal power mode may be reduced to around 40 ppm that is approximately ⅔, for example.

This may keep the fixing roller 706 at an even temperature in the power saving mode, as in the normal power mode. The passing intervals of recording media are not necessarily adjusted strictly to ⅔. The necessary intervals may vary depending on the configuration of the fixer and the surrounding environment. Therefore, the passage intervals may be predetermined to the extent for preventing defective fixing.

Figure 4:
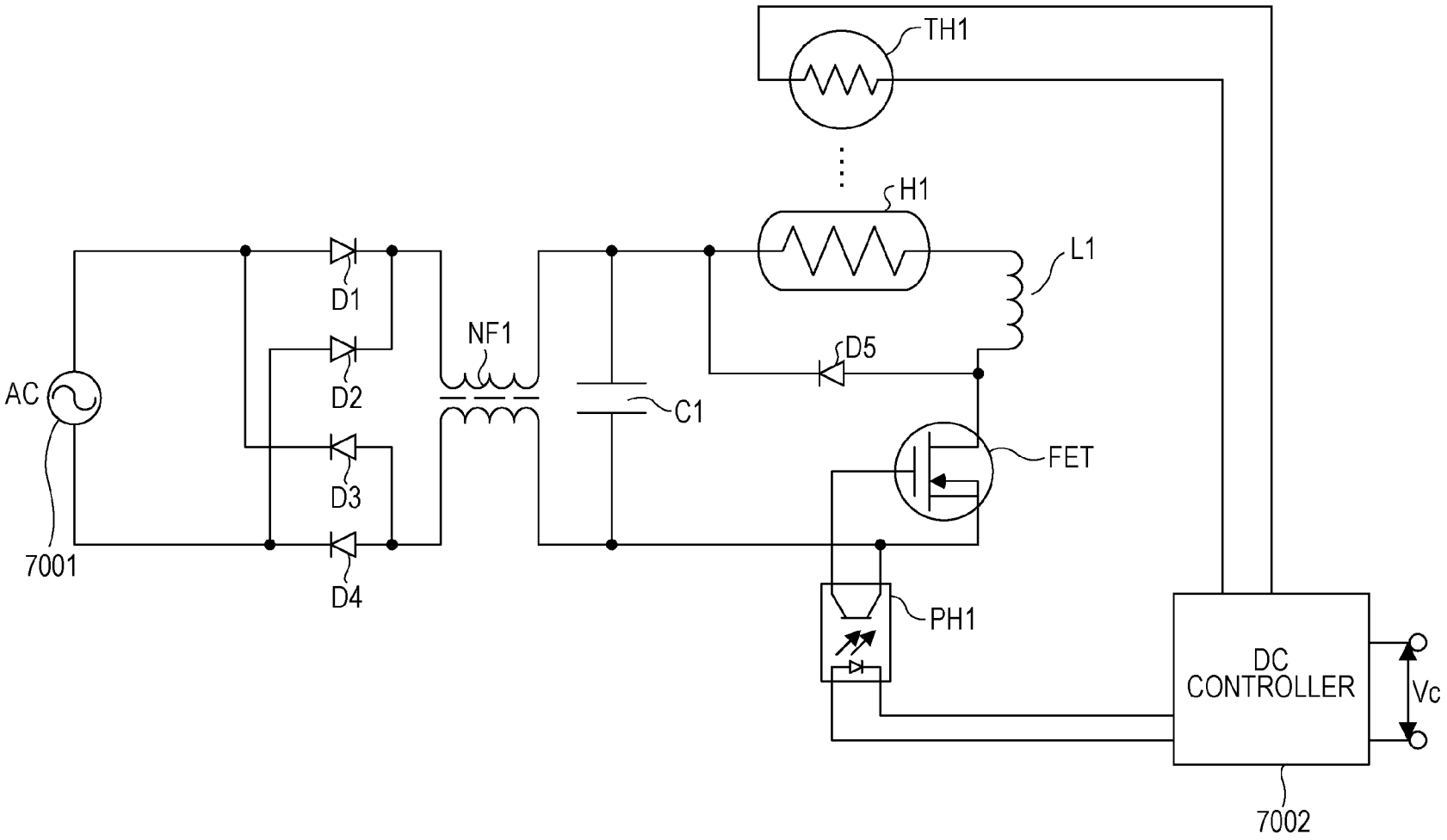
FIG. 4 illustrates an exemplary driving circuit for the fixers illustrated in FIG. 2.

As described above, according to this embodiment, providing three halogen heaters as illustrated in FIG. 3 allows combinations of a plurality of amounts of power. Alternatively, variable control over increase/reduction of the amount of power may be achieved by using one halogen heater and a controller based on constant voltage control and induction heating. FIG. 4 illustrates an example of such a controller.

FIG. 4 illustrates an example of a driving circuit for the first fixer 322 illustrated in FIG. 2. This example corresponds to an example of a constant voltage driving circuit.

Referring to FIG. 4, an AC input from an AC power supply 7001 is rectified and smoothed by diodes D1 to D4 and a capacitor C1. After that, a DC controller 7002, illustrated, may switch on/off an FET 1 through a coil L1 and a diode D5 for control over the increase/decrease of voltage to be applied. Thus, a desirable voltage may be applied to a heater H1, and the power consumption of the heater H1 may be adjusted based on a monitoring result of an output from a temperature sensor TH1 for the heater H1.

Conventionally, a fixer has been disclosed whose power consumption is adjustable by using a ceramic heater. Alternatively, a fixer has also been disclosed which allows multi-step power control by using a curbon heater. According to this embodiment, one of those fixers may be applied.

Figure 5:
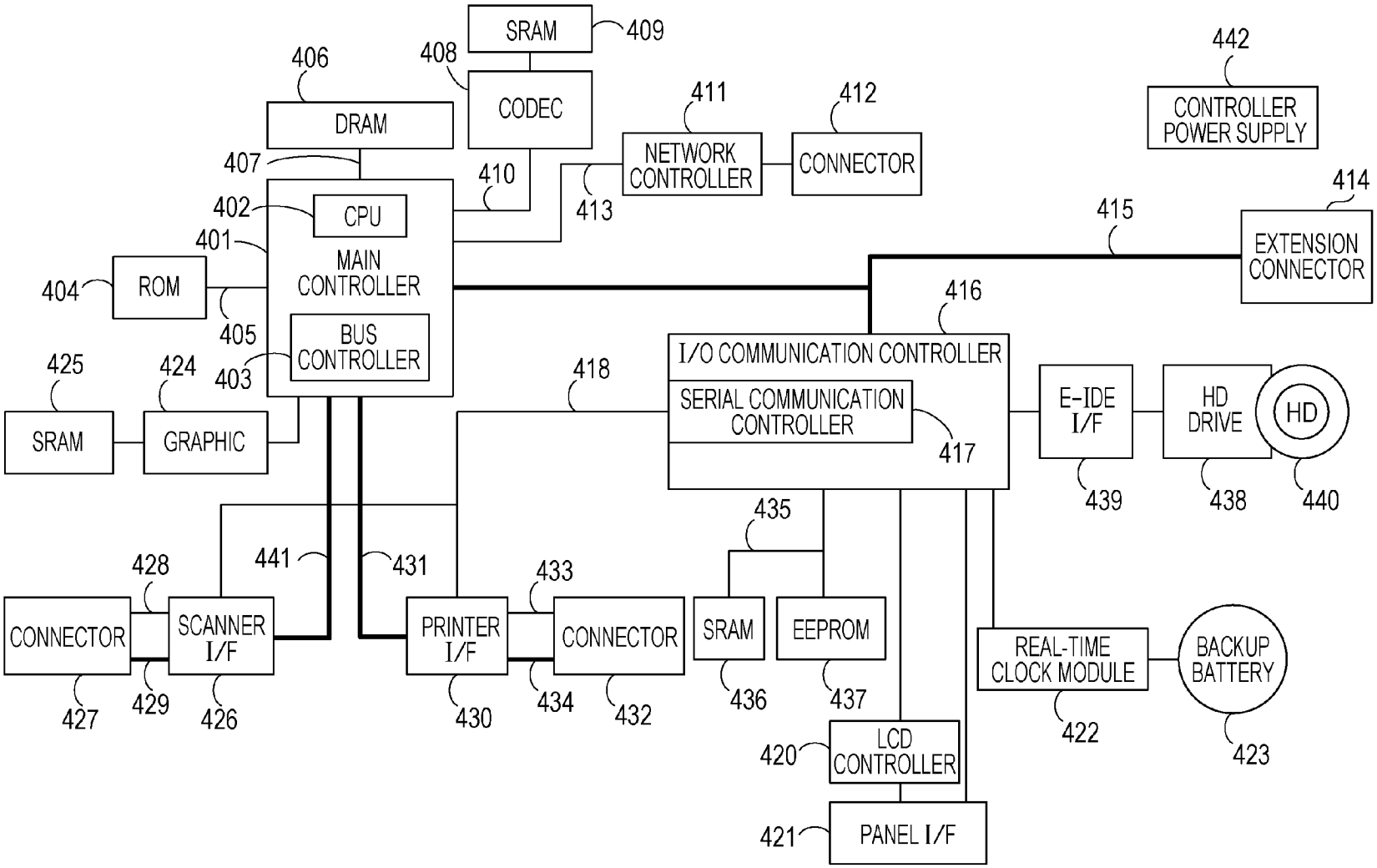
FIG. 5 is a block diagram illustrating a configuration of a controller.

FIG. 5 is a block diagram illustrating a configuration of the controller 102 illustrated in FIG. 1. The scanner unit 101, printer unit 103, and network interface unit in the image forming apparatus 100 will be described below in detail.

Referring to FIG. 5, a main controller 401 mainly includes a CPU 402, a bus controller 403 and interface (I/F) controller circuits. The CPU 402 and bus controller may control overall operations of the image forming apparatus 100. The CPU 402 operates based on a program read from a ROM 404 via a ROM I/F 405. Such a program may include descriptions of operations including interpreting PDL (page description language) code data received from a PC 108 and decompressing it to raster image data, which is to be processed by software.

The bus controller 403 controls transfer of data input/output to/from an I/F and may perform bus conflict arbitration and control over DMA data transfer.

A DRAM 406 is connected to the main controller 401 via a DRAM I/F 407 and is usable as a work area for operations performed by the CPU 402 and an area for storing image data.

The CPU 402 includes a CPU core, a memory controller, and a bus bridge. The CPU core includes a PLL (phase-locked loop) unit and caches (command cache and data cache) for multiplying system clocks to generate high speed CPU-core operation clocks. The CPU core and the bus bridge are connected via a front side bus 205, and the memory controller and the bus bridge are connected via a memory bus.

The memory controller may control reading/writing of data from/to the DRAM 406. The bus bridge is connected to an external bus to allow access from the CPU 402 to an external device and reading/writing data between an external device and the DRAM 406. A CPU power supply is provided externally to the CPU 402, and power received from a controller power supply 442 is supplied to the CPU core 201 by reducing the voltage of the power. A CPU power supply 208 is capable of supplying a plurality of voltage values to the CPU core in response to an instruction from the CPU 402.

A codec 408 compresses raster image data stored in the DRAM 406 by using a format such as MH/MR/MMR/JBIG/JPEG and decompresses compressed and stored code data to raster image data. An SRAM 409 is usable as a temporary work area for the codec 408. The codec 408 is connected to the main controller 401 via an I/F 410. Thus, data may be DMA transferred between the codec 408 and the DRAM 406 under control of the bus controller 403.

A graphics processor 424 performs processes on raster image data stored in the DRAM 406, such as image rotation, image magnification, color space conversion, and binarization. An SRAM 425 is usable as a temporary work area for the graphics processor 424. The graphics processor 424 is connected to the main controller 401 via an I/F, and data may be DMA transferred between the graphics processor 424 and the DRAM 406 under control of the bus controller 403.

A network controller 411 is connected to the main controller 401 via an I/F 413 and is connected to an external network through a connector 412. The network may generally be an Ethernet (registered trademark).

An extension connector 414 for accepting connection of an extension board and an I/O control unit 416 are connected to a general-purpose high speed bus 415. The general-purpose high speed bus may generally be a PCI bus. The I/O control unit 416 is equipped with 2 channels of asynchronous serial communication controllers 417 for transmitting and receiving control commands to and from CPUs of the scanner unit 101 and printer unit 103. The asynchronous serial communication controllers 417 are connected to a scanner I/F circuit 426 and a printer I/F circuit 430 via an I/O bus 418.

A panel I/F 421 is connected to an LCD controller 420 and includes an I/F usable for displaying on a screen on a liquid crystal display unit of the operating unit and a key input I/F usable for inputting through hardware keys and touch panel keys.

The operating unit 104 includes a liquid crystal display unit, a touch panel input device provided on the liquid crystal display unit, and a plurality of hardware keys. A signal input through the touch panel or hardware keys is transmitted to the CPU 402 through the panel I/F 421. The liquid crystal display unit displays image data transmitted from the panel I/F 421. The liquid crystal display unit may display functionality representations and image data, for example, involved in operations in the image forming apparatus. More specific screens displayed on the operating unit relating to the present invention will be described below.

A real-time clock module 422 updates/stores dates and times managed within the image forming apparatus and is backed up by a backup battery 423.

An E-IDE I/F 439 is usable for connection of an external storage device. According to this exemplary embodiment, the I/F may be used to connection a hard disk drive 438 so that operations may be performed including storing image data in a hard disk 440 and reading image data from the hard disk 440. Connectors 427 and 432 are connected to the scanner unit 101 and the printer unit 103, respectively, and include asynchronous serial I/Fs (428, 433) and video I/Fs (429, 434).

The scanner I/F 426 is connected to the scanner unit through a connector 427 and is connected to the main controller 401 through a scanner bus 441. The scanner I/F 426 is capable of performing a predetermined process on an image received from the scanner unit 101. The scanner I/F 426 is further capable of outputting to a scanner bus 429 a control signal generated based on a video control signal transmitted from the scanner unit. Data transfer from the scanner bus 429 to the DRAM 406 is controlled by the bus controller 403.

A printer I/F 430 is connected to the printer unit 103 through a connector 432 and is connected to the main controller 401 through a printer bus 431. The printer I/F 430 is capable of performing a predetermined process on image data output from the main controller 401 and outputting it to the printer unit 103 and is further capable of outputting to the printer bus 431 a control signal generated based on a video control signal transmitted from the printer unit 103.

Raster image data decompressed on the DRAM 406 is DMA transferred to the printer unit 103 through the printer bus 431 and a video I/F 434 under control of the bus controller 403.

An SRAM 436 is a memory configured to be capable of holding stored data even when the entire image forming apparatus is powered off by using power supply from the backup battery 423 and is connected to the I/O control unit via a bus 435. An EEPROM 437 is also a memory connected to the I/O control unit via the bus 435. The hardware components of the controller 102 have been described in detail above.

Figure 6:
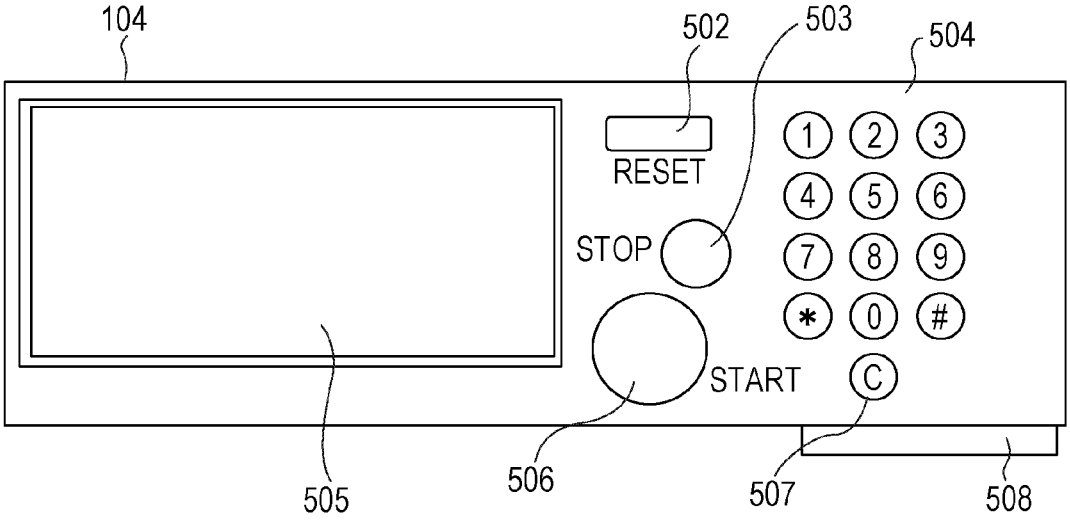
FIG. 6 is a plan view illustrating a configuration of an operating unit illustrated in FIG. 1.

FIG. 6 is a plan view illustrating a configuration of the operating unit 104 illustrated in FIG. 1. Operations to be performed for defining print settings will be described below with reference to FIG. 6. The operating unit 104 illustrated in FIG. 1 is connected subsequently to the panel I/F 421 illustrated in FIG. 5 and may receive an input and switches the UI screen to be displayed under control of the CPU 402. The display screen is lighted out in the power saving mode.

Referring to FIG. 6, the operating unit 104 includes a reset key 502 to be pressed for cancelling a set value defined by a user, for example. A stop key 503 may be pressed to abort processing performed by a job in operation. A numeric keypad 504 may be usable for inputting numeric values such as substituted numbers for number of copies to be printed.

Figure 7:
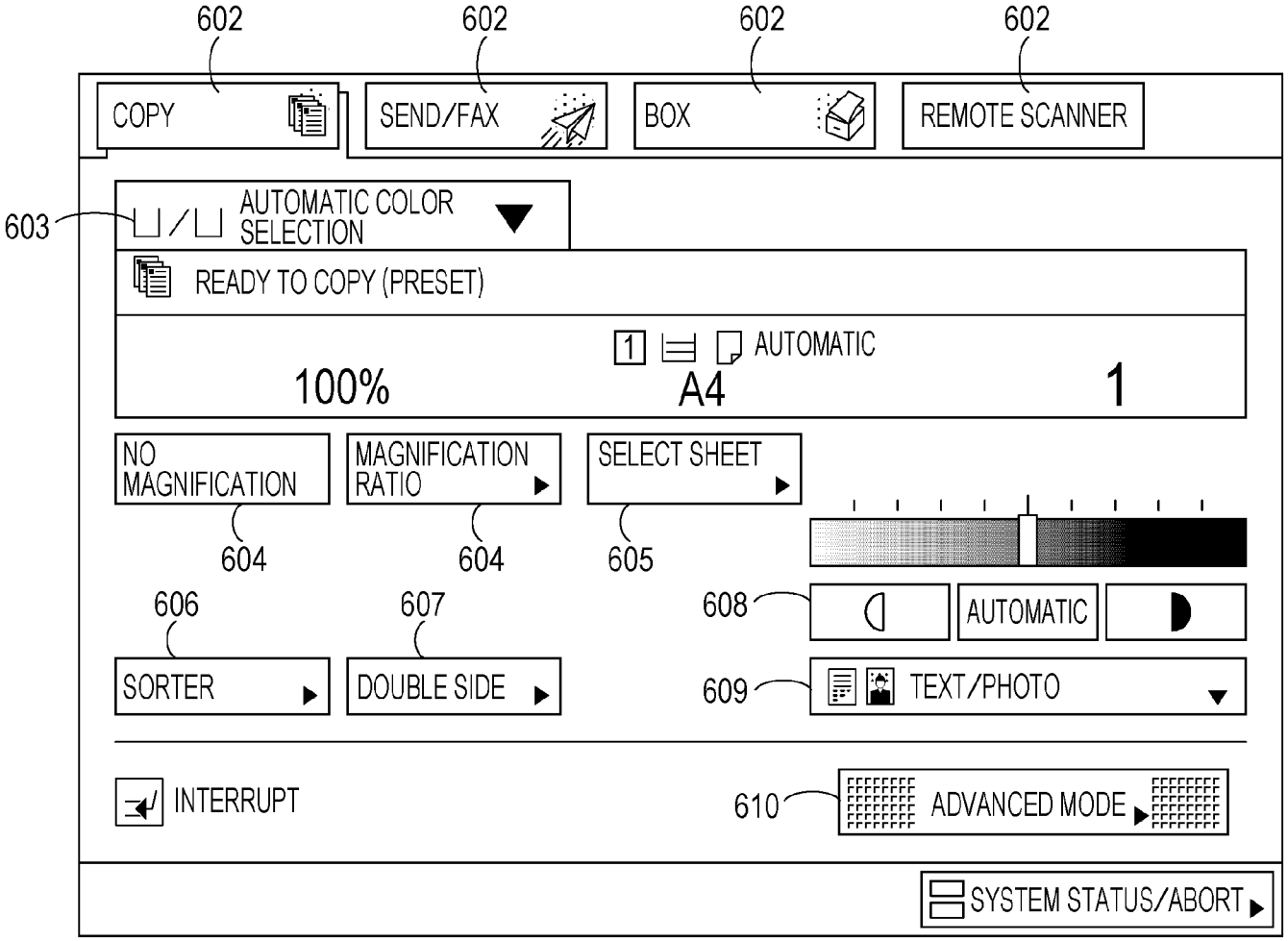
FIG. 7 illustrates an exemplary user interface (UI) screen displayed on an operation screen.

An operation screen 505 may be of a touch panel type and, more specifically, display s a UI screen as illustrated in FIG. 7. Many buttons are provided on the touch panel for defining settings.

A start key 506 may be used to start a job such as reading a document. A clear key 507 may be usable for clearing a setting. The components of the operating unit have been described above.

FIG. 7 illustrates an example of the UI screen to be displayed on the operation screen 505 illustrated in FIG. 5.

Referring to FIG. 7, tags 602 displayed in an upper part of the screen are usable for selecting corresponding functions. The functions may include a copy function, send functions such as fax transmission/E-mail transmission functions and a function for transmission to a fileserver. The functions may further include a box function and a remote scanning function. The box function is usable for storing image data read by the scanner unit 101 to the hard disk (HDD) 440 within the image forming apparatus and manipulating and printing stored data. The remote scanning function may be operated from the PC 108 over a network to capture a scanned image into the PC 108. In response to selection of a tag corresponding to one of these functions, a screen for advanced settings is displayed. The illustrated screen is for the copy function.

The screen includes a button 603 usable for selecting a color mode, a button 604 usable for designating a scaling factor, a button 605 usable for selecting a sheet type, and a sorter button 606 usable for designating a finishing type such as shift sort and staple sort. The screen further includes a double side printing button 607 usable for designating double side printing, a bar 608 usable for designate a density, a button 609 usable for selecting a document type, and an advanced mode button 610 usable for defining other advanced mode settings.

Figure 8:
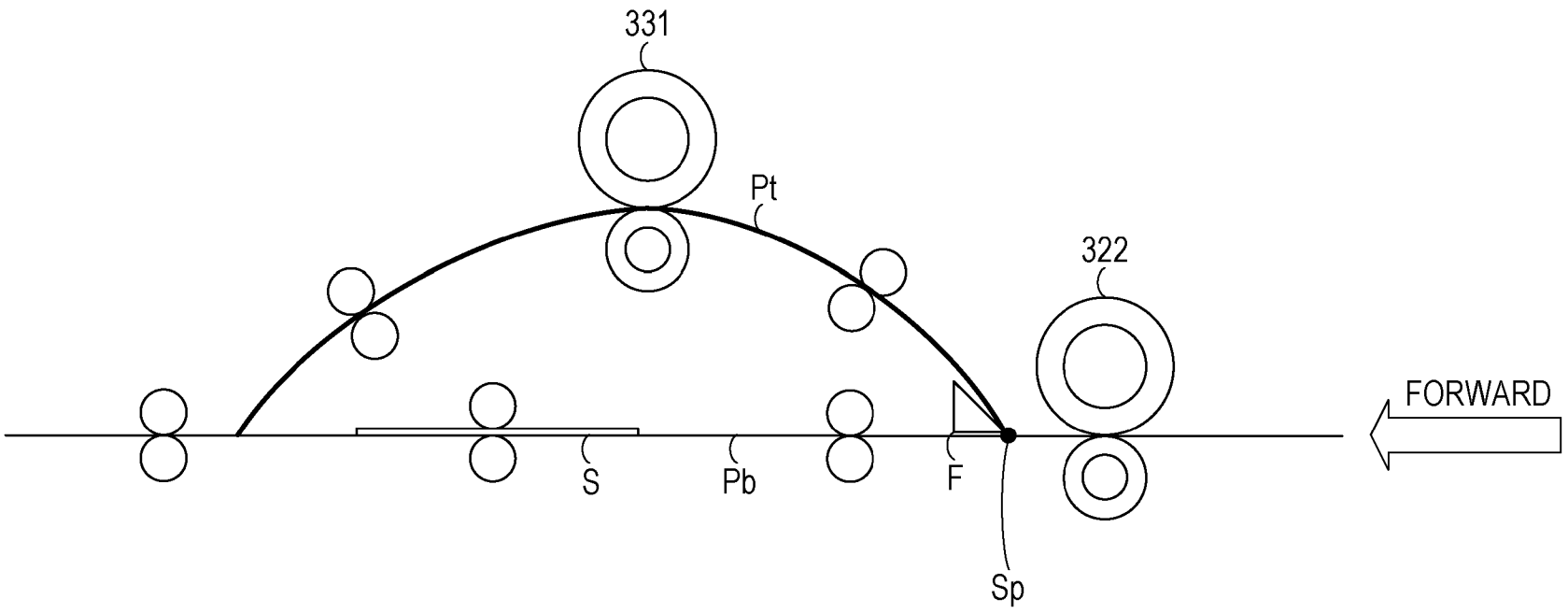
FIG. 8 illustrates a fixing operation in an image forming apparatus.

FIG. 8 illustrates fixing operations performed in an image forming apparatus according to this embodiment. According to this embodiment, the image forming apparatus may include two fixing units and a path for passing through the fixing units, for example.

Referring to FIG. 8, a first fixer 322 and a second fixer 331 are provided on a downstream side of the image forming unit. The first fixer 322 is usable for fixing a toner image on a material S as a permanent image. The second fixer 331 is usable for additionally performing, in response to a request, a fixing process on a material having passed through the first fixer 322.

The first fixer 322 and second fixer 331 sandwich and convey a material by using a rotating body pair and at the same time fix the toner thereon to the material by using heat from a heating device and sandwiching pressure from the rotating body pair.

The conveying path is divided into a tandem path Pt leading to the second fixer 331 and a bypass Pb for bypassing the second fixer 331 in a downstream part of the first fixer 322 and meet in a downstream part of the second fixer 331. A flapper F is provided at a branching point Sp to the tandem path Pt and the bypass Pb. The flapper F is a conveying-path switching unit being capable of switching between the tandem path Pt and the bypass Pb. One of the conveying paths may be selected in response to a request signal from the controller 102.

Some materials such as a second side of a normal or thick sheet may curl up or wind itself around a fixing roller when it passes through two or more fixers and an excessive amount of heat is applied thereto as a result. Such a material may be conveyed through the bypass Pb and bypass the second fixer 331 if the satisfactory fixability may be obtained through one fixer.

On the other hand, a material requiring passage through the first fixer 322 and second fixer 331 for improved fixability may be conveyed through the tandem path Pt. According to this embodiment, two fixers as illustrated in FIG. 8 are used. However, the present invention relates to an image forming apparatus including a plurality of fixers and is not limited to those having two fixers.

First Fixing Control

Figure 9:
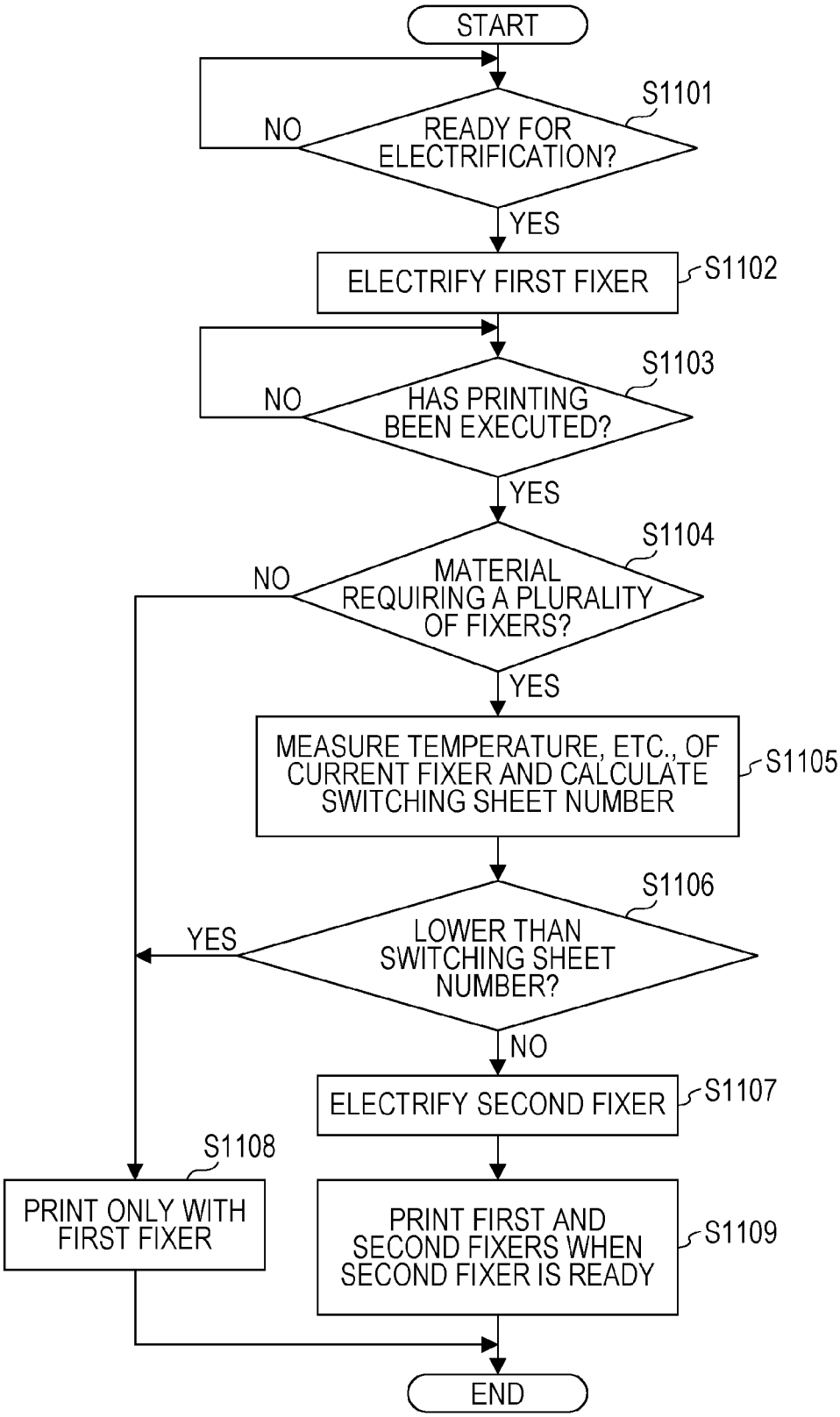
FIG. 9 is a flowchart illustrating a control method for an image forming apparatus.

FIG. 9 is a flowchart illustrating an exemplary control method for an image forming apparatus according to this embodiment. The illustrated example corresponds to a first fixing control method for an image forming apparatus having the second fixer. The steps on the flowchart are implemented by executing a control program stored in the ROM 404 by the CPU 402. In the control example, the second fixer 331 is not electrified until the first fixer 321 performs a fixing process on a predetermined number of sheets.

First of all, the CPU 402 in the controller 102 checks whether the two fixers are ready for conduction (S1101). The state "ready for electrification" here refers to a state where the necessity for electrification is determined based on a sensing result from a motion sensor, for example, which may sense an operator, for example, who is approaching the image forming apparatus after activation or after sleep return. In this step, if the CPU 402 determines that they are ready for electrification, the first fixer 322 is electrified until a fixable temperature is obtained (S1102).

Next, the CPU 402 determines whether a print job is inserted or not (S1103). The CPU 402 determines whether a plurality of fixers (first fixer 322 and second fixer 331) are to be used for the material to be used by the print job (S1104). In S1104, the CPU 402 uses a table as illustrated in FIG. 10.

FIG. 10 illustrates an example of a fixing control table stored in the HDD 440 illustrated in FIG. 5. The table may have contents that are updatable in response to addition of a usable material. FIG. 10 shows a use flag 1202 indicative of whether the second fixer 331 is required for performing a normal fix process on a material 1201. For example, referring to FIG. 10, for a material 1201 of a normal sheet type may require use of the first fixer 322 only while a material 1201 of a glossy sheet type may require use of both of the first fixer 322 and second fixer 331.

If the CPU 402 determines in S1104 that the job designates a material not requiring a plurality of fixers, the printing is implemented with the first fixer 322 only (S1108), and the processing ends.

On the other hand, if the CPU 402 determines in S1104 that the job designates a material requiring use of a plurality of fixers, the CPU 402 calculates the number of output sheets (switching sheet number) for switching between use of the first fixer 322 only or use of the first fixer 322 and second fixer 331 for printing by using the following expression (S1105).

$$N \leq (T2-T1)/(t1-t2)$$

where

N: switching sheet number t1: printing time for one sheet when the first fixer 322 is only used.

t2: printing time for one sheet when the first fixer 322 and the second fixer 331 are used.

T1: time required until the first fixer 322 is ready.

T2: time until the second fixer 331 is ready.

T1 includes a time required for obtaining a fixable temperature and a processing time for changing a processing speed. T1 depends on parameters for the current temperature of the fixer and a change of the processing speed, for example. A matrix of those parameters, not illustrated, may be created, and a time T for each parameter may be calculated in advance.

T2 includes a time required for obtaining a fixable temperature. T2 depends on the current temperature of the fixer. A matrix of the parameters, not illustrated, may be created, and a time T for each parameter may be calculated in advance.

If the CPU 402 determines in S1106 that the number of output sheets is lower than the switching sheet number, the CPU 402 reduces the processing speed of the first fixer 322 to fix with the first fixer 322 only for printing (S1108). Thus, in a case where printing with the first fixer 322 only is faster than the printing with the first fixer 322 and the second fixer 331, printing may be performed with the first fixer 322 only, which may suppress power consumption. On the other hand, if the CPU 402 determines that the number of output sheets is equal to or higher than the switching sheet number, the CPU 402 also electrifies the second fixer 331 (S1107). The CPU 402 then uses both of the fixers when the second fixer 331 is ready for printing (S1109), and the processing ends.

This may reduce power consumption of the heat-fixing processing even when the material requires use of a plurality of fixing units.

According to the first embodiment, power consumption of the heat-fixing processing may be reduced even when the material requires use of a plurality of fixing units.

Second Embodiment

First Fixing Control

Figure 11:
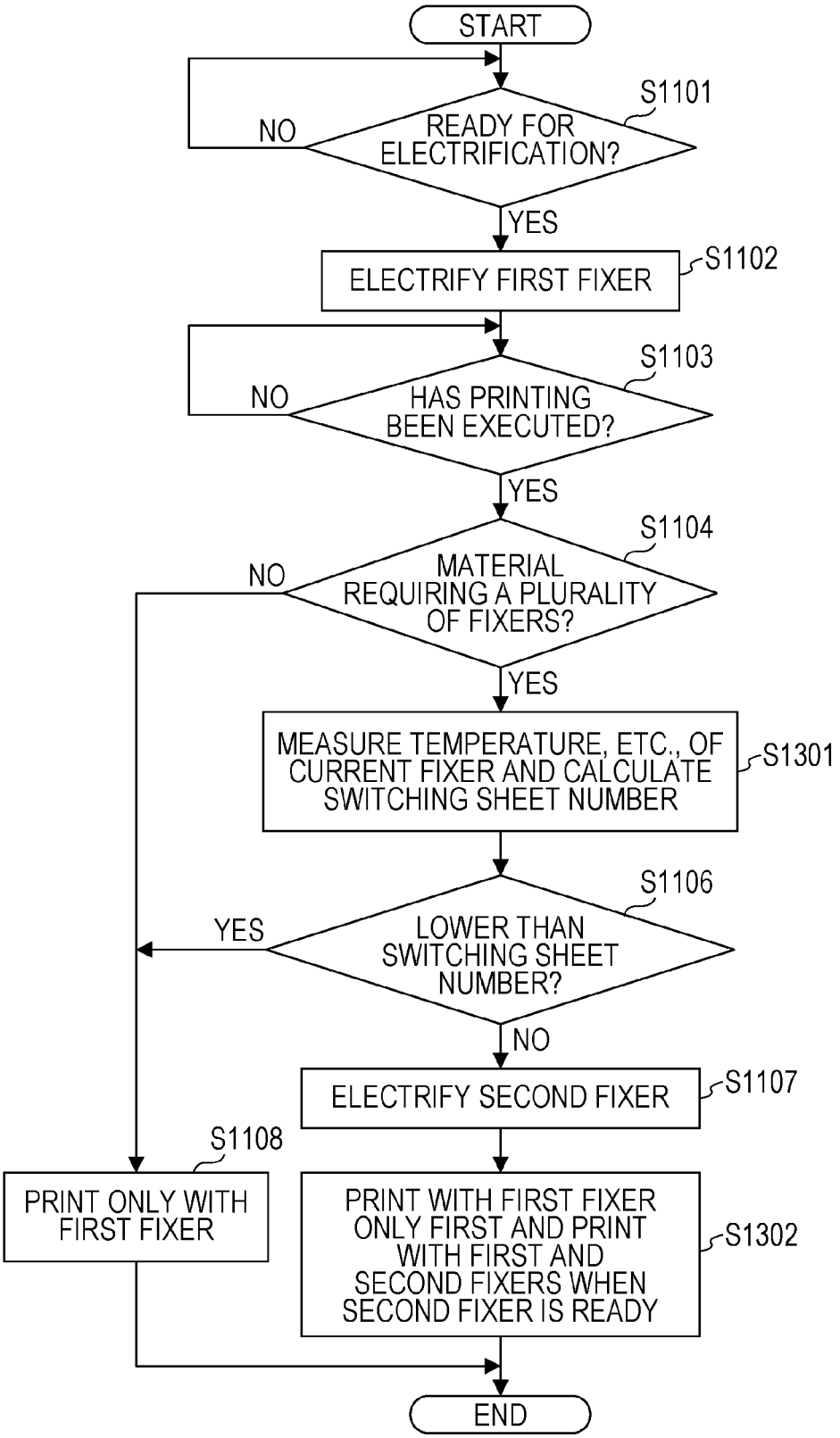
FIG. 11 is a flowchart illustrating a control method for an image forming apparatus.

FIG. 11 is a flowchart illustrating an exemplary control method for an image forming apparatus according to a second embodiment. The illustrated example corresponds to a first fixing control method for an image forming apparatus having the second fixer. The steps on the flowchart are implemented by executing a control program stored in the ROM 404 by the CPU 402. Because the S1101 to S1104 and S1106 to S1108 in the illustrated processing are the same as those in the flowchart illustrated in FIG. 9, the description will be omitted.

According to the first embodiment, the output speed obtained when two fixers are used and the output speed obtained when one fixer is only used are compared to determine whether two fixers will be used or one fixer will only be used for faster printing. According to this embodiment, the switching sheet number is calculated by assuming that the first fixer is used until the second fixer 331 is ready in a case where it is determined that two fixers are to be used. This may improve output performance in a case where the second fixer 331 is also used. The switching sheet number in that case may be calculated by the following expression.

$$N \leq (T2*t1-T1*(t1+t2))/t1*(t1-t2)$$

If the CPU 402 determines that the second fixer is also required to be electrified (S1107), the CPU 402 first continues printing with the first fixer 322 only and then performs printing by using the first fixer 322 and second fixer 331 when the second fixer 331 is ready.

Third Embodiment

Figure 12:
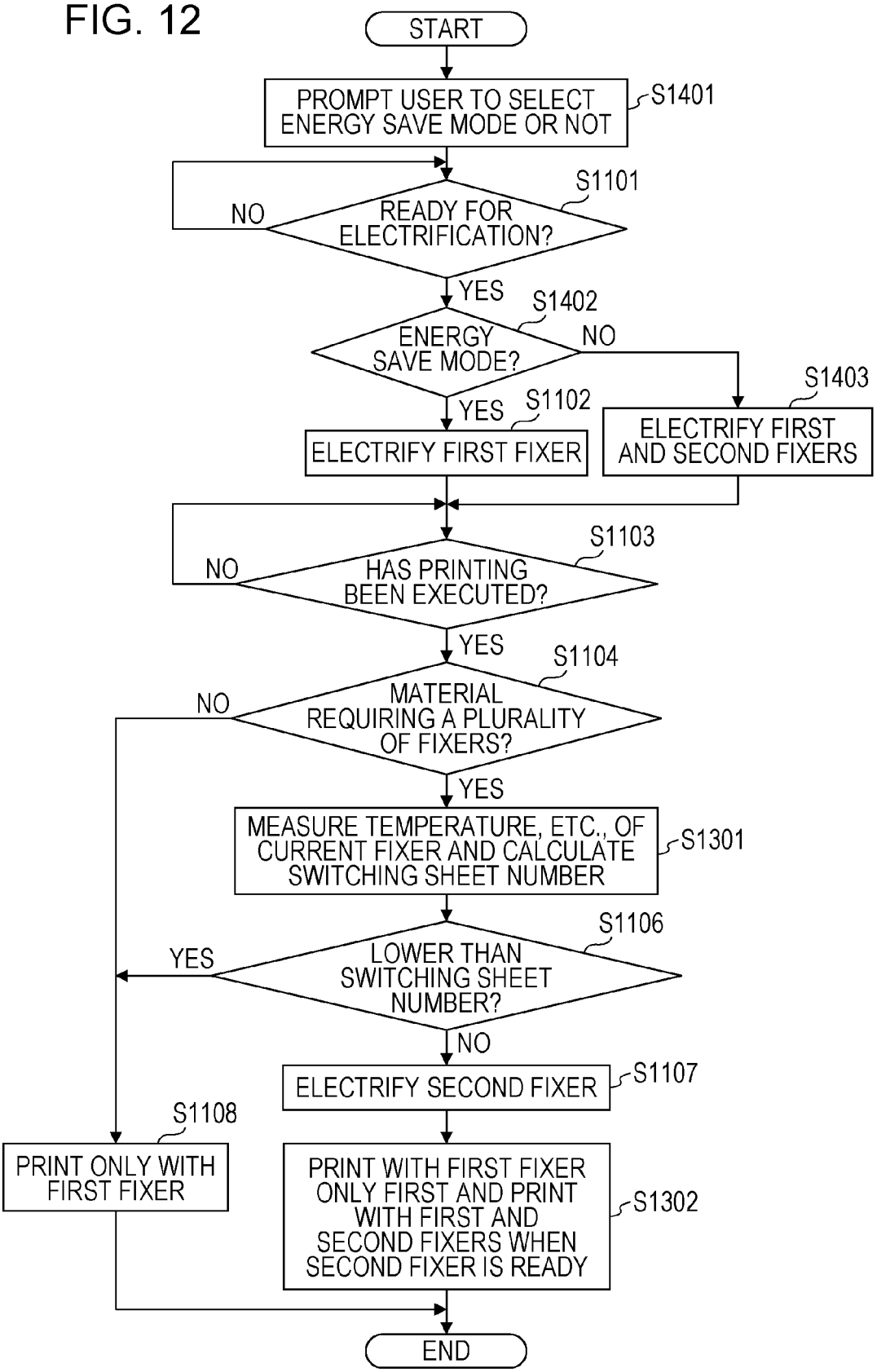
FIG. 12 is a flowchart illustrating a control method for an image forming apparatus.

FIG. 12 is a flowchart illustrating an exemplary control method for an image forming apparatus according to this embodiment. The illustrated example corresponds to a first fixing control method for an image forming apparatus having the second fixer. The steps on the flowchart are implemented by executing a control program stored in the ROM 404 by the CPU 402. Because the S1101 to S1104 and S1106 to S1108 in the illustrated processing are the same as those in the flowchart illustrated in FIGS. 9 and 11, the description will be omitted.

The first embodiment and second embodiment assume that a print job is inserted when the second fixer 331 is not electrified. Such an assumption is valid in a power saving mode. However, it does not result in very proper operations in a case where the output performance for a material requiring use of the second fixer 331 is important. Accordingly, this embodiment addresses it by providing a mode in which the second fixer 331 is electrified in advance.

According to this embodiment, an "Energy Save Mode" button usable for switching to the mode in which the second fixer 331 is electrified in advance may be presented to a user on a UI screen displayed on the operating unit 104 to prompt a user to select (S1401). It should be noted that this processing may be performed during an initial setting operation, and the setting may be stored as system information in a non-volatile memory (HDD 440). The system setting information may be invoked when the system is powered on so that the work for executing the processing every time may be omitted. Alternatively, it may be achieved by invoking an initial setting screen to change or update settings as required.

If a state that electrification is ready is obtained (S1101) and the CPU 402 determines that a user has selected the energy save mode (power saving request), the first fixer 322 is only electrified, like the first embodiment and second embodiment (S1102).

On the other hand, if the CPU 402 determines that the energy save mode has not been selected by a user, the CPU 402 electrifies the first fixer 322 and second fixer 331 (S1403). The flow then moves to S1103.

If the CPU 402 determines that a job has been inserted for outputting with a material requiring use of a plurality of fixers when the second fixer is electrified (S1104), the CPU 402 calculates the switching sheet number, like the second embodiment (S1301).

This control may suppress power consumption when the energy save mode is selected, like the first embodiment and second embodiment. The power consumption may also be suppressed without using the second fixer 331 for some number of output even when the energy save mode is not selected.

Fourth Embodiment

The first to third embodiments assume that a single print job using an identical material is inserted. Cases will be described in which print jobs are inserted serially and in one job uses a mix of a material requiring use of a first fixer only and a material requiring use of the first fixer and a second fixer for printing.

A case in which print jobs are inserted serially will be described. When the type of the material regarding use of the second fixer 331 (use flag 1202) is identical across jobs, the number of materials of the same type across jobs may be handled as the number of output sheets to be compared with the switching sheet number in S1106. This allows more proper switching for power saving.

A case will be described in which a mix of types of materials regarding the use flag 1202 for the second fixer exists within one job illustrated in FIG. 10. Also in this case, the CPU 402 calculates the switching sheet number (S1301), like the second embodiment, basically at a part where the type of materials differs (S1104). However, if the CPU 401 determines that the first fixer 322 will be used for printing (S1108), T1 includes not only the time until a fixable temperature is obtained (warm-up time) and a time for processing for changing the processing speed but also a time for outputting materials retained within the image forming apparatus.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

The present invention is not limited to the aforementioned embodiments, various changes (including organic combinations of the embodiments) may be made based on the spirit of the present invention and are not excluded from the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-181329 filed Sep. 2, 2013, which is hereby incorporated by reference herein in its entirety.

What is claimed is:

1. An image forming apparatus comprising:

an image forming unit configured to transfer a developing agent to a sheet for image forming;

a first fixing unit and second fixing unit each configured to perform a heat-fixing process on the developing agent transferred to the sheet by the image forming unit;

a determination unit configured to determine whether the sheet is of a type for which both the first fixing unit and the second fixing unit are to be used; and a controller configured to perform print processing using both the first fixing unit and the second fixing unit, if the determination unit determines that the sheet is of a type for which both the first fixing unit and the second fixing unit are to be used, wherein the controller performs print processing using the first fixing unit without using the second fixing unit if the number of sheets to be printed in the print processing is lower than a predetermined number, even if the determination unit determines that the sheet is of a type for which both the first fixing unit and the second fixing unit are to be used.

2. The image forming apparatus according to claim 1, further comprising a receiving unit configured to receive a power saving request for the second fixing unit, wherein if the receiving unit receives the power saving request, the controller controls so that power supply to the second fixing unit is stopped.

3. The image forming apparatus according to claim 1, wherein, in a case where a plurality of types of sheet are used in the print processing, the determination unit determines whether the sheet is of a type for which both the first fixing unit and the second fixing unit are to be used when the type of sheet is switched.

4. The image forming apparatus according to claim 1, wherein a first processing speed in the print processing using the first fixing unit without using the second fixing unit is lower than a second processing speed in the print processing using both the first fixing unit and the second fixing unit.

5. A control method for an image forming apparatus having an image forming unit configured to transfer a developing agent to a sheet for image forming and a first fixing unit and a second fixing unit each configured to perform a heat-fixing process on the developing agent transferred to the sheet by the image forming unit, the method comprising:

determining whether the sheet is of a type for which both the first fixing unit and the second fixing unit are to be used for performing a heat-fixing process; and performing print processing using both the first fixing unit and second fixing unit, if the determining determines that the sheet is of a type for which both the first fixing unit and second fixing unit are to be used for performing a heat-fixing process, wherein performing print processing using the first fixing unit without using the second fixing unit if the number of sheets to be printed in the print processing is lower than a predetermined number, even if the determining determines that the sheet is of a type for which both the first fixing unit and the second fixing unit are to be used.

6. The control method for the image forming apparatus according to claim 5, further comprising receiving a power saving request for the second fixing unit, wherein if the receiving receives the power saving request, the controlling so that power supply to the second fixing unit is stopped.

7. The control method for the image forming apparatus according to claim 5, wherein, in a case where a plurality of types of sheet are used in the print processing, the determination unit determines whether the sheet is of a type for which both the first fixing unit and the second fixing unit are to be used when the type of sheet is switched.

8. The control method for the image forming apparatus according to claim 5, wherein a first processing speed in the print processing using the first fixing unit without using the second fixing unit is lower than a second processing speed in the print processing using both the first fixing unit and the second fixing unit.

* * * * *